THREE DIMENSIONAL RELIEF PUZZLE

This invention relates to three dimensional puzzles and more particularly to a multipart three dimensional relief puzzle comprising a plurality of separate parallelepiped blocks having varying heights which are assembled together into a finished form by matching 1. side surfaces, 2. randomly sized and spaced interlock means, and 3. curvatures of upper and lower surfaces.

Prior to the present invention various types of three-dimensional puzzles have been provided for educational and recreational purposes. One of these prior art puzzles incorporates a plurality of relatively thin rectilinear pieces equal in size which can be assembled together into a finished rectangular configuration using the upper surface contour of the various pieces as a guide. In another three dimensional puzzle a spherical assembly is produced by mating pieces identical in shape using surface texture as a guide. A superfluous piece of this prior art puzzle is properly excluded on the basis of having a different surface texture. A third three dimensional puzzle comprises a plurality of flat slices or parts having irregular peripheral shapes that can be vertically stacked in a predetermined manner to form a completed assembly. Another prior puzzle has identical parts which are assembled together in a linear manner by using cooperating pin and hole interlock means and by matching printed matter on the side faces of the parts.

While these prior art puzzles have added to the state of the art they generally have only one or two variables and are simple in nature and are only satisfactory for specific educational or training purposes or as an amusement device for children. The puzzle of this invention is unique as compared to the prior art in terms of design, assembly and manufacturing technique. This puzzle may be advantageously employed for a wide range of educational and training purposes, it is entertaining to adults and children, and in its completed form it is aesthetically pleasing. Generally the basic components of this invention comprise a plurality of parallelepiped blocks each usually having a height greater than the base dimension which may be assembled together to form a composite. The blocks are generally of the same cross sectional shape and in the preferred form are provided with flat faces disposed at right angles with respect to an adjacent interface. The faces of the various blocks are further provided with special pin and hole interlock means randomly spaced and randomly sized in a plurality of horizontal and vertical planes within the puzzle. In addition to congruent surface and pin and hole matching, the blocks of this invention have curved upper or curved upper and lower surfaces which must be matched with adjacent parts for proper puzzle solution.

The special pin and hole interlock means in the preferred embodiment of this invention are uniquely employed to inhibit assembly of a piece or a subassembly of pieces into the puzzle if such assembly would simultaneously involve two separate planes. This generally requires that the puzzle be assembled into subassemblies which are subsequently assembled together to form the composite. The pin and hole interlock means are preferably invisible when the puzzle is assembled so as not to detract from the aesthetic quality of the puzzle when completed. Also the spacing of the pin and hole interlock of each pair of blocks exhibits randomness for instructional purposes and being random these interlocks do not provide any clue as to how adjacent blocks are to be joined into the puzzle.

After being assembled, the upper surface or the upper and lower surfaces of the puzzle form predetermined curves which may be that of a sine wave, an ellipse, hyperbola, parabola, rotated straight line or other curved configuration. The assembled puzzle is a work of art for display but is ready for breakdown and reworking. With such curvatures the completed puzzle illustrates a physical embodiment of a geometric or a three dimensional mathematical function. In other words, at least one surface of the puzzle can be described by a mathematical equation so that a person can visualize and better understand the mathematical expression.

In a second form of the invention the parallelepiped blocks are secured together by vertically extending cylindrical pin and hole interlock means of differing height and diameter sizes and locations. In the second embodiment a piece or a subassembly of pieces is inserted vertically into the puzzle and can be simultaneously connected to blocks disposed at right angles to each other.

This invention further incorporates a new and improved method of manufacture of three dimensional puzzles. Initially a plurality of parallelepiped blocks are provided with pin and hole interlock means at predetermined locations and assembled into a polyhedron. After being assembled, a cut determined by the desired geometric surface is made to separate the polyhedron into two parts with identical surfaces. After cutting, the surfaces may be smoothed and finished as desired.

These and other objects, features and advantages of this invention will become more apparent from the following detailed description and drawing in which.

Figure 1:
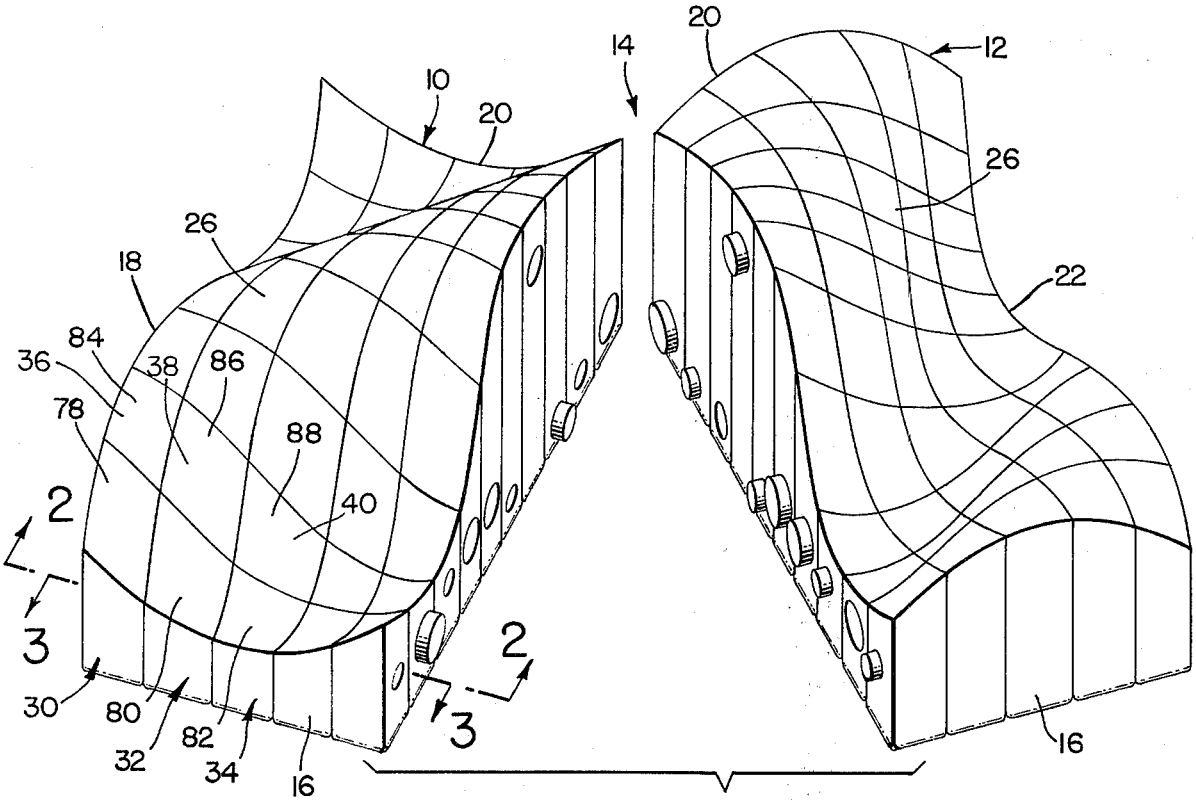
FIG. 1 is a perspective view of one of the embodiments of the invention split into two subassemblies.
Figure 2:
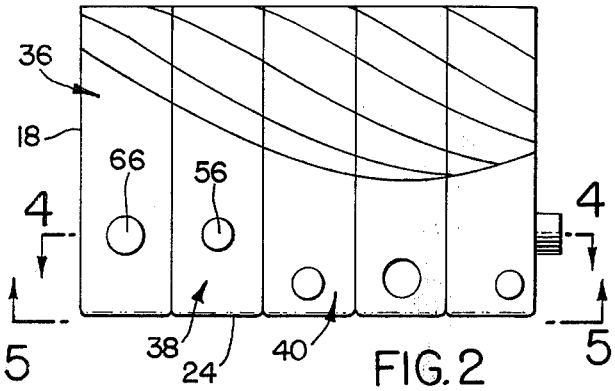
FIG. 2 is a side view taken along line 2—2 of FIG. 1.
Figure 3:
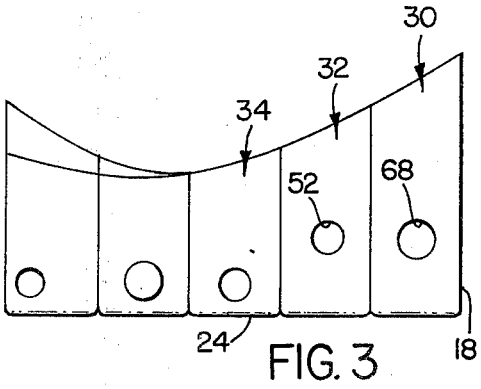
FIG. 3 is a side view taken along line 3—3 of FIG. 1.
Figure 4:
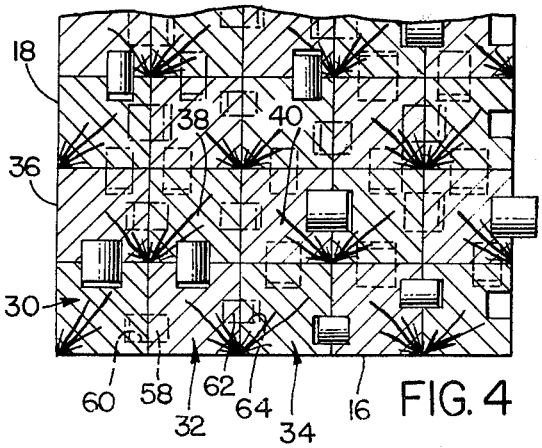
FIG. 4 is a sectional view taken along line 4—4 of FIG. 2.
Figure 5:
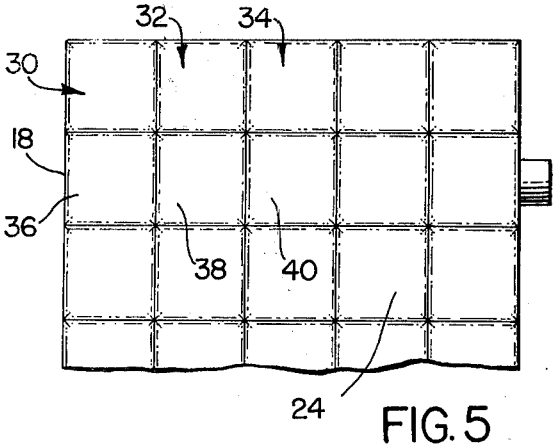
FIG. 5 is a bottom plan view taken along line 5—5 of FIG. 2.
Figure 6:
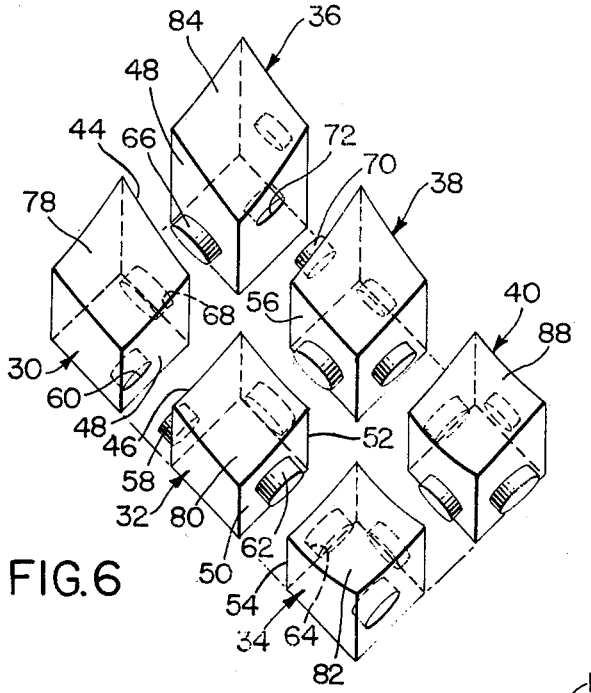
FIG. 6 is a perspective view of six of the basic components used in the embodiment of FIG. 1.
Figure 7:
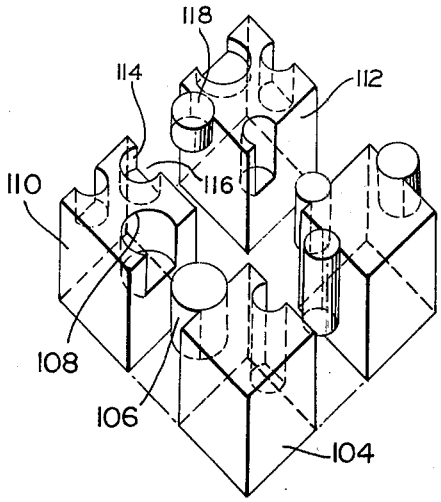
FIG. 7 is a perspective view of four of the basic components of a second embodiment of the invention.
Figure 8:
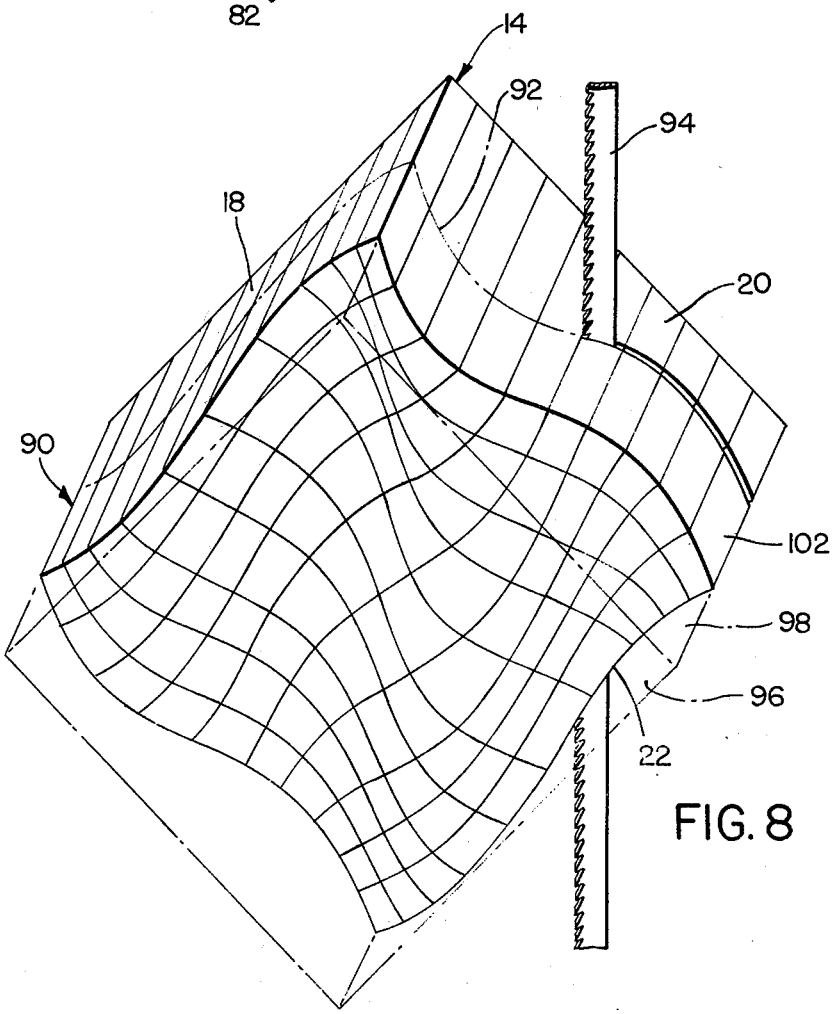

FIG. 8 is a perspective view illustrating a method of manufacture of this invention Turning now in greater detail to the drawing, there is shown in FIG. 1 two subassemblies 10 and 12 which form separate halves of a three dimensional relief puzzle 14. With the two subassemblies 10 and 12 joined together, the puzzle is generally block-like in formation bounded by planar sides 16, 18, 20, 22, a flat bottom surface 24 and a curved upper surface 26. In the embodiment shown in FIG. 1 the upper surface is in the form of a sinusoid. However, this surface may have the curvature of an ellipse, a hyperbola, a rotating straight line curve or other curvature. Also, various curved surfaces may be employed instead of the planar sides and bottom surfaces. The puzzle 14 is comprised of a plurality of individual parallelepiped blocks each having inner side surfaces which are adapted to abut one another in a predetermined random manner to form the puzzle 14. As shown in FIG. 6, for example, blocks 30, 32, 34, 36, 38 and 40 have planar sides that closely match one another to provide side to side fits at their said side faces of said pieces except said faces which form peripheral surfaces of said composite, for securing said puzzle pieces to each other in said predetermined manner, said interlock means comprising projection means of varying size extending from the side faces of predetermined pieces of said puzzle and corresponding openings for close mating engagement with said projection means when said pieces are assembled into said rows and subsequently into said composite, said interlock means being thus disposed at a plurality of different heights throughout said composite, said puzzle pieces when assembled into said composite forming a planar lower surface and a curved upper surface describing a physical embodiment of a regular three-dimensional mathematical function.

2. The relief puzzle defined in claim 1 wherein said interlock means comprise cylindrical pin means projecting horizontally from predetermined side faces of said pieces into corresponding cylindrical hole means formed in other predetermined side faces of said pieces.

3. The relief puzzle defined in claim 1 wherein said interlock means comprise cylindrical pin means projecting horizontally from predetermined side faces of said pieces into corresponding cylindrical hole means formed in other predetermined side faces of said pieces, a first group of said pin and hole means having a diameter different from a second group of said pin and hole means, said pin and hole means being randomly spaced throughout said puzzle so that the location of any one of said pin and hole means does not give a clue as to the location of any other of said pin and hole means.

* * * * *

United States Patent [19]

Nunziato

[11] 3,981,507

[45] Sept. 21, 1976

[54] GOLF CLUB HEAD CONSTRUCTION

[76] Inventor: Charles Nunziato, Rte. No. 1, Westville, Fla. 32464

[22] Filed: July 22, 1974

[21] Appl. No.: 490,869

[52] U.S. Cl. ..... 273/164; 273/167 A

[51] Int. Cl.[2] ..... A63B 53/04

[58] Field of Search ..... 273/67 R, 77 R, 78, 273/79, 80 C, 164, 167–174

[56] References Cited

UNITED STATES PATENTS

| | | | |
|---|---|---|---|
| 645,944 | 3/1900 | Dalgleish | 273/174 X |
| 786,268 | 4/1905 | Corey et al. | 273/168 |
| 1,336,671 | 4/1920 | Backus | 273/167 E |
| 1,511,479 | 10/1924 | Kelly et al. | 273/168 X |
| 2,336,405 | 12/1943 | Kent | 273/79 |
| 3,088,736 | 5/1963 | Mospan | 273/167 A X |
| 3,392,977 | 7/1968 | DeLacey | 273/168 X |
| 3,397,888 | 8/1968 | Springer et al. | 273/168 X |
| 3,486,755 | 12/1969 | Hodge | 273/164 |
| 3,572,709 | 3/1971 | Risher | 273/167 K X |
| 3,901,514 | 8/1975 | Priaulx | 273/168 |
| D179,002 | 10/1956 | Hoffmeister | 273/164 X |
| D193,897 | 10/1962 | Vachon | 273/168 UX |
| D209,149 | 11/1967 | Sowers | 273/164 UX |
| D213,382 | 2/1969 | Risher | D34/5 GH |
| D219,156 | 11/1970 | Risher | D34/5 GH |
| D229,431 | 11/1973 | Baker | D34/5 GH |

FOREIGN PATENTS OR APPLICATIONS

| | | | |
|---|---|---|---|
| 1,063,798 | 3/1967 | United Kingdom | 273/167 A |
| 5,739 | 3/1910 | United Kingdom | 273/167 J |
| 15,597 | 7/1904 | United Kingdom | 273/80 C |

*Primary Examiner*—Richard J. Apley
*Attorney, Agent, or Firm*—Clarence A. O'Brien; Harvey B. Jacobson

[57] ABSTRACT

A golf club is provided and includes an upstanding shank portion and a lower head portion carried by the lower end of the shank portion. The head includes top, bottom, front, rear and inner and outer sides and the shank portion extends upwardly from the head at a point on the top side thereof adjacent the front and inner sides of the head at an angle upwardly and outwardly inclined from the inner side of the head. The inner and outer sides generally parallel each other and the outer side, rear and top sides are substantially mutually right-angularly disposed. The front side or face is rearwardly and upwardly inclined and the bottom side of the head is slightly convex with the axis of curvature thereof disposed in a vertical plane extending at generally right angles to a vertical plane containing the shaft portion of the club.

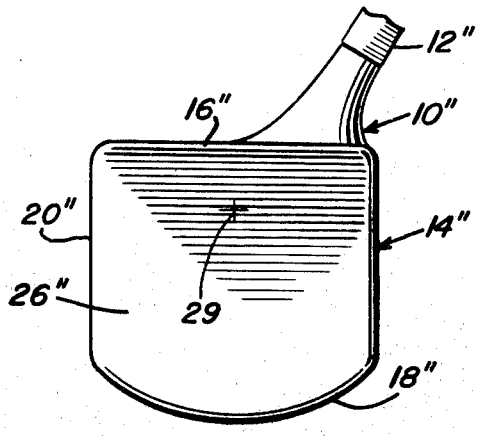

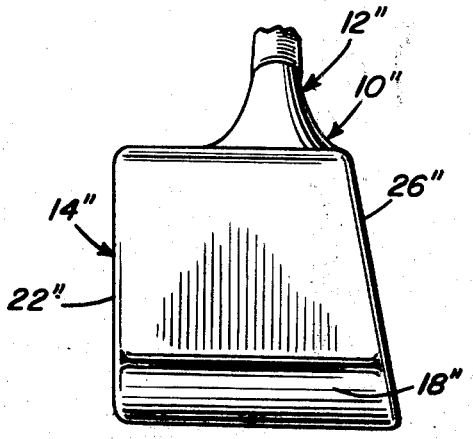

1 Claim, 6 Drawing Figures